United States Patent [19]

Güttler et al.

[11] Patent Number: 4,942,729

[45] Date of Patent: Jul. 24, 1990

[54] APPARATUS FOR ALIGNING A STRAND SUPPLY DEVICE AND A STRAND GUIDE OF A TEXTILE MACHINE

[75] Inventors: Hermann Güttler, Uhingen; Karl-Heinz Mark, Weilheim, both of Fed. Rep. of Germany

[73] Assignee: Zinser Textilmaschinen GmbH, Ebersbach/Fils, Fed. Rep. of Germany

[21] Appl. No.: 413,480

[22] Filed: Sep. 27, 1989

[30] Foreign Application Priority Data

Sep. 27, 1988 [DE] Fed. Rep. of Germany ..... 3832665

[51] Int. Cl.[5] ..... D01H 15/00; D01H 15/013; D01H 5/58; D01H 13/06

[52] U.S. Cl. ..... 57/261; 57/279; 57/359

[58] Field of Search ..... 57/261, 262, 279, 358–360, 57/12, 90; 19/288–292

[56] References Cited

U.S. PATENT DOCUMENTS

| | | | |
|---|---|---|---|
| 3,832,839 | 9/1974 | McClure | 57/261 |
| 4,030,281 | 6/1977 | Schopper et al. | 57/261 X |
| 4,176,514 | 12/1979 | Stalder | 57/261 |
| 4,404,790 | 9/1983 | Frederick | 57/12 |
| 4,438,622 | 3/1984 | Pons | 57/261 |

FOREIGN PATENT DOCUMENTS

| | | |
|---|---|---|
| 1923377 | 11/1970 | Fed. Rep. of Germany . |
| 3536850 | 4/1987 | Fed. Rep. of Germany . |
| 3626268 | 2/1988 | Fed. Rep. of Germany . |

*Primary Examiner*—John Petrakes

*Attorney, Agent, or Firm*—Shefte, Pinckney & Sawyer

[57] ABSTRACT

An apparatus for aligning a textile strand supple device and a strand guide of a drafting device of a textile machine is provided for initially inserting a textile strand into the strand guide. The strand guide of the drafting device is typically reciprocally moved transversely to the direction of feed of the textile strand and the aligning apparatus of the present invention includes a device for securing the strand guide at a predetermined position along its reciprocating path at which a conventional movable service unit can be positioned for initially inserting a textile strand into the strand guide. According to another aspect of the present invention, the aligning apparatus includes a motor assembly for adjustably moving the textile strand supply device in response to the sensed position of the strand guide of the drafting device. According to another aspect of the present invention, the aligning apparatus includes a device for resiliently adjusting the strand guide of the drafting device in response to the position of the textile strand supply device.

14 Claims, 4 Drawing Sheets

APPARATUS FOR ALIGNING A STRAND SUPPLY DEVICE AND A STRAND GUIDE OF A TEXTILE MACHINE

BACKGROUND OF THE INVENTION

The present invention relates to a method and apparatus for initially inserting a strand of a textile material into a drafting device of a textile machine and, more particularly, a method and apparatus for aligning an initial strand inserting device and a strand guide of a drafting device in an alignment position at which a strand can be initially inserted into the strand guide.

In German Offenlegungsschrift No. 36 26 268, a device is disclosed for initially inserting a roving end into the yarn guide and the first pair of rollers of a drafting device of a textile machine. The roving end inserting device is operable to insert the roving through a side slot in the roving guide of the drafting device to thereby dispose the roving within the roving guide. The side slot extends along the entire extent of the roving guide to permit lateral insertion of the roving into the roving guide.

The roving guide of a drafting device is typically reciprocally moved along a path extending generally transverse to the direction of feed of roving through the rollers of the drafting device. This reciprocating movement tends to lessen the risk that the roving guide will wear excessively on one portion as the roving is guided therethrough since the reciprocating action of the roving guide continuously varies the portion of the inner surface of the roving guide over which the roving travels thereby spreading the wear on the inner surface of the roving guide more uniformly. However, the reciprocating movement of the roving guide complicates the process of initially inserting the roving end into the roving guide since the roving guide may be located at any one of a number of positions along its reciprocating travel path when the need arises to initially insert a strand therein. Moreover, the initial insertion process is further complicated if the roving guide is not provided with a side slot for introducing the roving into the roving guide. Accordingly, the need exists for a method and apparatus for insuring the reliable insertion of a strand into the strand guide of a drafting device.

SUMMARY OF THE INVENTION

Briefly described, the present invention provides an apparatus for a textile machine of the type having a supply of a strand of textile material, a device for drafting the strand of textile material, a reciprocable member, a strand guide mounted on the reciprocable member for guiding the strand from the strand supply to the drafting device, a device for reciprocating the reciprocable member transversely with respect to the strand during operation of the drafting device to effect reciprocating movement of the strand guide relative to the drafting device during the feed of the strand through the strand guide to the drafting device, and a device for initially inserting the strand into the strand guide. The apparatus includes a device for aligning the initial strand inserting device and the strand guide with respect to one another in an alignment position at which the strand is initially inserted into the strand guide.

According to one aspect of the present invention, the aligning apparatus includes a device for uncoupling the reciprocable member from the device for reciprocating the reciprocable members and a device for selectively securing the reciprocable member at a predetermined position in alignment for initial insertion of a strand in the strand guide by the initial strand inserting device.

According to another aspect of the present invention, the aligning apparatus includes a device for sensing the position of the strand guide and device, operatively connected to the sensing device, for moving the initial strand inserting device relative to the strand guide to align the initial strand inserting device and the strand guide with one another at the alignment position. According to a further aspect of the present invention, the aligning apparatus includes a device for sensing the position of the strand guide and a device, operatively connected to the sensing device, for moving the reciprocable member in response to the sensed position of the strand guide to position the strand guide at the alignment position. The aligning apparatus includes, in one aspect, a first component disposed on the initial strand inserting device and a second component disposed on the reciprocable member adjacent the strand guide, the first and second components cooperating together to form a passage for travel of the strand therethrough from the initial strand inserting device to the strand guide at the alignment position.

According to one aspect of the present invention, the aligning apparatus includes a first component disposed on the initial strand inserting device and a second component disposed on the reciprocable member adjacent the strand guide, the first and second components cooperating together to form a passage for travel of the strand therethrough from the initial strand inserting device to the strand guide at the alignment position. Additionally, the aligning apparatus includes a laterally projecting member mounted to the reciprocable member for movement therewith during the reciprocating movement, the projecting member being movable about the axis of reciprocation of the reciprocable member, and the uncoupling device includes a member formed in the device for reciprocating the reciprocable member for receiving the radially projecting member therein and a device for selectively moving the radially projecting member into and out of engagement with the receiving member. Moreover, the aligning apparatus includes a laterally projecting member mounted to the reciprocable member for movement therewith during the reciprocating movement, the projecting member being movable about the axis of reciprocation of the reciprocable member and the device for selectively securing the reciprocable member at a predetermined position includes a projection receiving member for receiving the radially projecting member therein when the reciprocable member is uncoupled from the device for reciprocating the reciprocable member and a device for selectively moving the radially projecting member into and out of engagement with the projection receiving member.

In one form of the present invention, the uncoupling device includes a receiving component formed in the device for reciprocating the reciprocable member for receiving the radially projecting member therein to effect coupling of the device for reciprocating the reciprocable member and the reciprocable member and the device for selectively moving the radially projecting member moves the radially projecting member alternately into engagement with one of the projection receiving members of the device for reciprocating the reciprocable member and the device for selectively securing the reciprocable member, and out of engagement with the other of the device for reciprocating the reciprocable member and the device for selectively securing the reciprocable member. Additionally, the aligning apparatus includes a device for sensing the positioning of the strand guide at the alignment location, the device for selectively moving the radially projecting member acting to move the radially projecting member in response to the sensing of the strand guide at the alignment location to uncouple the reciprocable member from the device for reciprocating the reciprocable member. The second component includes a pair of laterally projecting, axially spaced arms, each of the arms being axially displaced from the strand guide in a respective axial direction with respect to the reciprocable member, the initial strand inserting device includes a portion having a channel for feed of the strand therethrough and the first component of the initial strand inserting device is movable with respect to the channel portion and compatibly configured for receipt between the arms of the second component.

According to another aspect of the present invention, the second component includes a pair of laterally projecting, axially spaced arms, each of the arms being axially displaced from the strand guide in a respective axial direction with respect to the reciprocable member, the second device being axially movable with respect to the reciprocable device during receipt of the end portion in the arms and the initial strand inserting device includes an end portion for feed therethrough of the strand, the end portion being receivable between the arms.

DETAILED DESCRIPTION OF THE PREFERRED EMBODIMENTS

Figure 1:
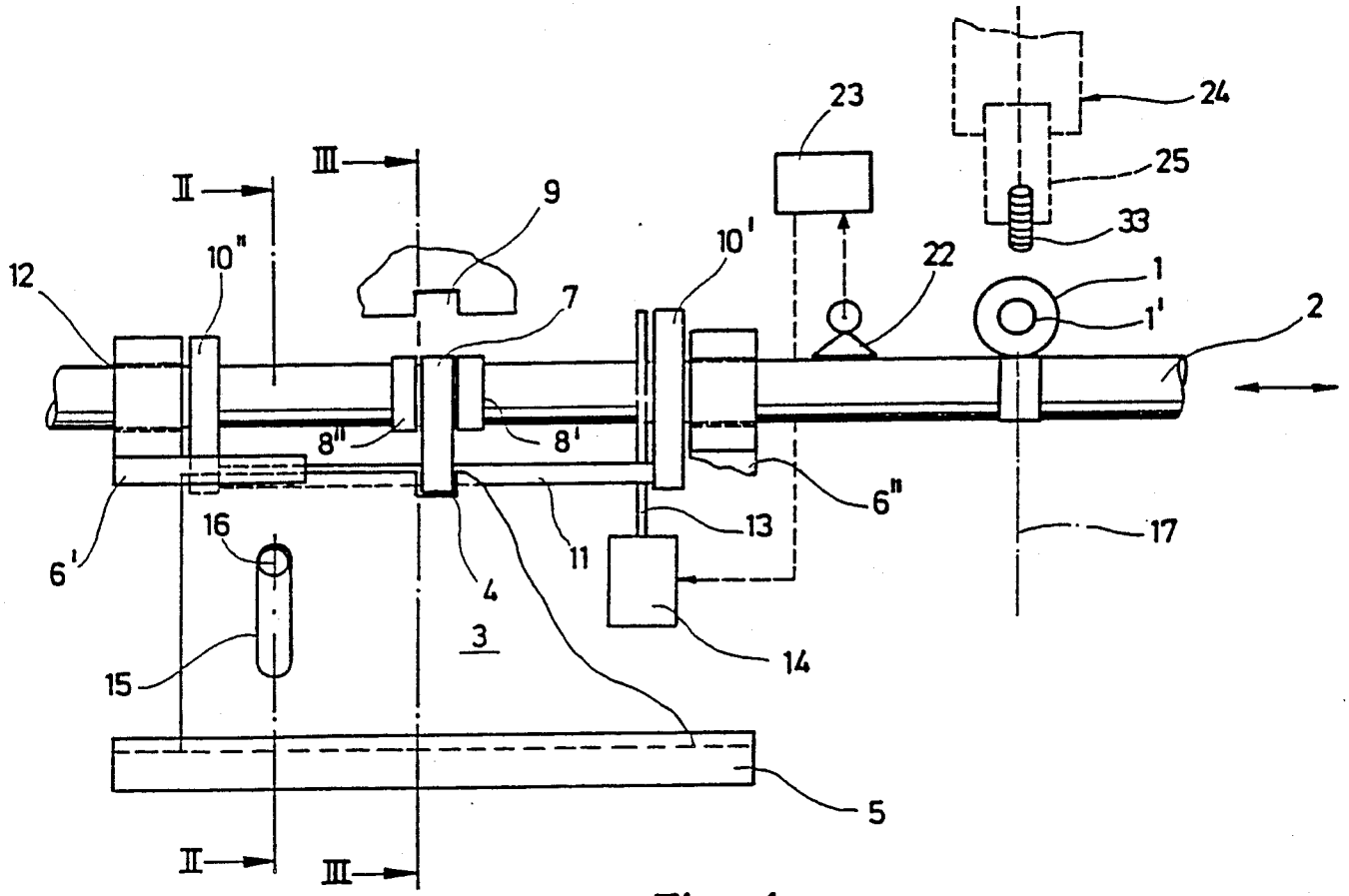
FIG. 1 is a front perspective view of one embodiment of the aligning apparatus of the present invention.
Figure 3:
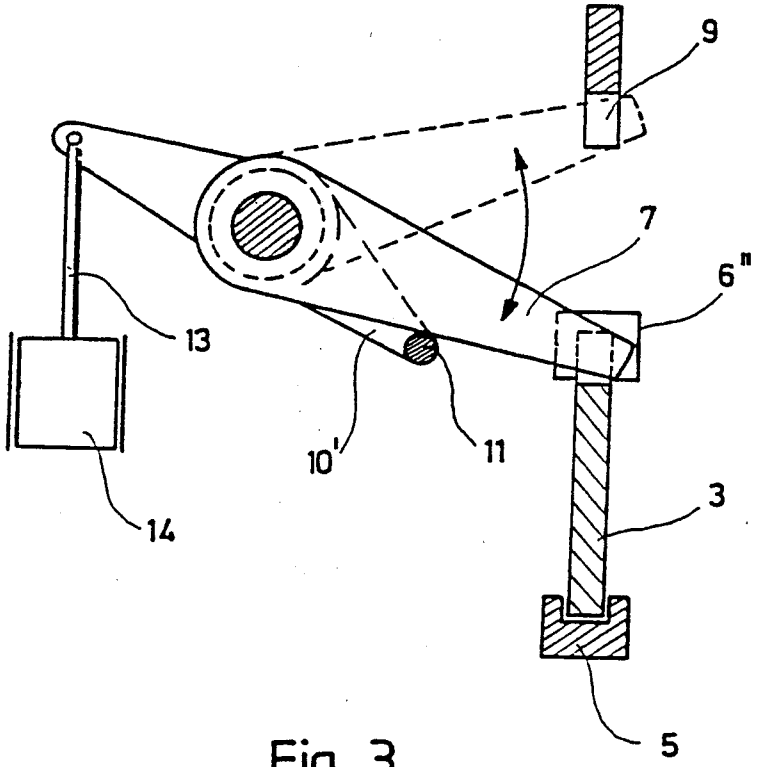
FIG. 3 is a transverse vertical sectional view of a portion of the aligning apparatus shown in FIG. 1, taken along line III—III of FIG. 1.
Figure 2:
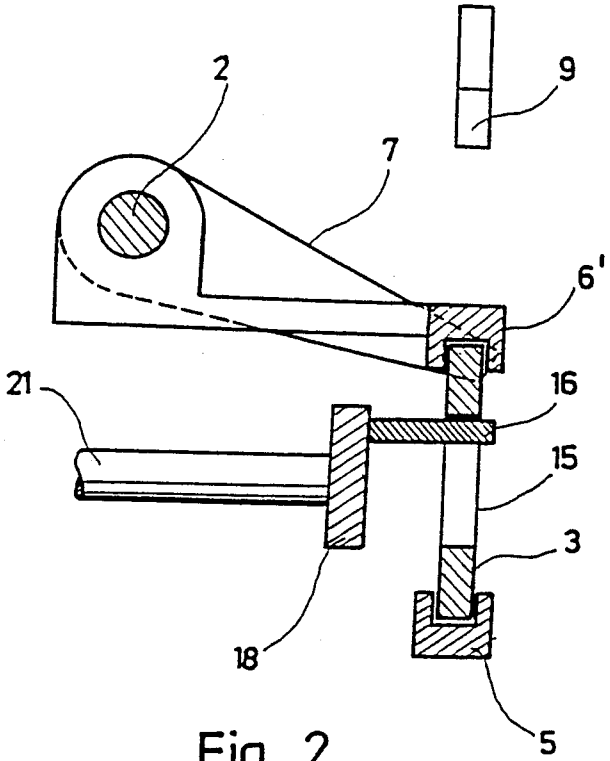
FIG. 2 is a transverse vertical sectional view of a portion of the aligning apparatus shown in FIG. 1, taken along line II—II of FIG. 1.

FIGS. 1–3 illustrate one embodiment of the apparatus of the present invention for aligning a textile strand supply device and a strand guide of a drafting device of a textile machine for intial insertion of a strand into the strand guide. A textile machine such as, for example, a ring spinning machine, includes a drafting device for drafting roving or another strand of textile material therethrough. The ring spinning machine includes a plurality of strand guides 1 mounted to a reciprocable member such as, for example, a cylindrical shaft 2, extending transversely of the strand path and means for reciprocating the shaft 2. The cylindrical shaft 2 is movably mounted within the bearings 12 of a pair of mounting members 6', 6'' spaced axially from one another along the shaft and supporting the shaft for reciprocating axial movement. The strand guides are identically configured and are positioned at spacings along the shaft in correspondence with the positions of the plurality of drafting devices along the machine.

The ring spinning machine additionally includes a conventional traveling service unit (not shown) having means for initially inserting a strand into a strand guide such as, for example, an insertion device 24. The insertion device 24 includes a clamping element 25 for clamping the strand of textile material 33 such as, for example, the end of a supply of roving, to insert the strand in one of the strand guides 1 of the ring spinning machine.

The means for reciprocating the shaft 2 includes a conventional drive motor (not shown) having a drive shaft 21 extending transversely with respect to the reciprocating shaft 2, as best seen in FIG. 2. A disk 18 is fixedly coaxially mounted to the free end of the drive shaft for rotation therewith. A cylindrical drive pin 16 is mounted at one end to the disk 18 at an offset from the axis of the drive shaft 21 for movement in a circular path upon rotation of the drive shaft. Each of the mounting members 6', 6'' includes a downwardly opening horizontally extending guide channel extending parallel with the reciprocating shaft 2. A guide channel member 5 extends parallel with the reciprocating shaft 2 and has an upwardly opening guide channel vertically spaced from, and parallel with, the channels of the mounting members 6', 6''. A generally rectangular drive plate 3 is disposed with vertically spaced horizontal edges disposed in the guide channels of the guide channel member 5 and the mounting member 6', 6'' for guided sliding reciprocation. The drive plate 3 includes a vertically extending drive slot 15 for receiving the drive pin 16 therein to translate circular motion of the pin 16 into reciprocation of the drive plate 3.

As seen in FIGS. 2 and 3, a means for selectively coupling and uncoupling the shaft 2 and the drive plate 3 is provided. As seen in FIG. 2, the selective coupling and uncoupling means includes an arm 7 pivotally mounted on the shaft 2 and projecting radially therefrom, the arm 7 being constrained from movement along the axis of the shaft 2 by a pair of collars 8', 8'' that are secured to the shaft 2 on each side of the arm 7. The collars 8', 8'' are selectively fixedly adjustable along the shaft 2 to selectively adjust the axial position of the arm 7 with respect to the shaft 2. The drive plate 3 includes a drive plate notch 4 along its top edge for receiving the free end of the arm 7 therein so that the arm 7 can selectively interconnect the shaft 2 to the drive plate 3 for transmitting the reciprocating motion of the drive plate 3 to the shaft 2.

The aligning apparatus of the present invention additionally provides a means for selectively engaging and disengaging the arm 7 with the drive plate notch 4 on the drive plate 3. As seen in FIG. 1, the selective engagement and disengagement means includes a pair of counterweight arms 10', 10'' each movably mounted to the shaft 2 at axially spaced positions thereon between the mounting members 6', 6''. The selective engagement and disengaging means serves to move the arm 7 about the axis of the shaft 2 to move the free end of the arm into and out of engagement with the drive plate notch 4 and to move the free end of the arm into and out of engagement with a positioning notch member 9 located generally laterally opposite the shaft 2 from the drive plate 3. The positioning notch member 9 has a notch for receiving the free end of the arm 7.

In accordance with the present invention, means are provided for aligning the insertion device 24 and the strand guide 1 with respect to one another in an alignment position at which the strand is initially inserted into the strand guide.

Each counterweight arm 10', 10'' includes a first portion extending laterally from the cylindrical shaft 2 and the first portions of the counterweight arms 10', 10'' are interconnected by a cross shaft 11 extending therebetween and connected at one respective end thereof to each of the first portions. The counterweight arm 10' additionally includes a second portion projecting laterally from the cylindrical shaft 2 generally diametrically oppositely the first portion of the counterweight arm. As seen in FIG. 3, movement of the counterweight arms 10', 10'' brings the cross shaft 11 into contact with the arm 7 to effect movement of the arm 7 about the shaft 2 from the solid line position to the broken line position shown in FIG. 3. The movement of the counterweight arms 10', 10'' is driven by a conventional electromagnetic assembly including a stem 13 projecting therefrom. The free end of the stem 13 is pivotally mounted to the free end of the second portion of the counterweight arm 10'. The conventional electromagnetic assembly is of the type in which the counterweight 14 is magnetically active and configured to cooperate with a magnetically active bore for vertical movement within the bore in response to energization of the magnetic bore.

To control the operation of the aligning apparatus of the present invention, a conventional control device 23 is provided. The control device 23 is operatively connected to the electromagnetic assembly for selectively energizing and deenergizing the assembly to effect movement of the arm 7 about the shaft 2. Additionally, the control device 23 includes a conventional signal receiving means for receiving a signal from a conventional sensor 22 which is mounted to the shaft 2 at a predetermined axial position thereon. The sensor 22 moves in correspondence with the movement of the shaft 2 and emits a signal indicating when it is axially aligned with the signal receiving means of the control device 23.

The operation of the aligning apparatus of the present invention will now be described. The aligning apparatus is operable to initially insert a strand of textile material in the strand guide 1 following a break in the supply of the strand, the exhaustion of the strand supply or some other interruption in the feed of the strand through the strand guide 1. In normal operation, the strand of textile material is fed from a strand supply through the strand guide 1 for feed therethrough to the drafting device of the ring spinning machine while the cylindrical shaft 2 is driven in a reciprocal manner by the drive plate 3. The reciprocal movement of the shaft 2 insures that the strand traveling through the strand guide 1 travels over continuously varying portions of the inner bore of the strand guide such that the wear on the inner bore is advantageously spread over an arcuate extent thereof instead of occurring at a single location.

The reciprocal movement of the cylindrical shaft 2 is effected as follows. As the drive shaft 21 rotates, the drive pin 16 is rotated by the disk 18 around a circular path. The drive pin 16 imparts movement to the drive plate 3 as the pin travels around its circular path while being retained within the drive slot 15, thereby effecting reciprocating movement of the drive plate 3 within the guide channels of the mounting members 6', 6'' and the longitudinal guide channel of the guide channel member 5.

The reciprocating movement of the drive plate 3 is transmitted to the cylindrical shaft 2 via the arm 7. Specifically, the free end of the arm 7, as shown in FIGS. 1 and 2, is received in the drive plate notch 4. Since the arm 7 is axially fixed relative to the cylindrical shaft 2 by the collars 8', 8'', axial movement of the arm 7 by the drive plate 3 produces axially reciprocating movement of the cylindrical shaft 2 relative to the mounting members 6', 6''. While the cylindrical shaft 2 moves relative to the counterweight arms during the axial movement of the shaft, the counterweight arms 10', 10'' remain in position between the mounting members 6', 6''.

When an interruption of the feed of the strand of textile material through the strand guide 1 occurs as a result of, for example, the exhaustion of the supply of the strand material or a break in the strand, the alignment apparatus of the present invention is operable to align the insertion device 24 and the strand guide 1 with respect to one another in an alignment position at which the strand is initially inserted into the strand guide. Specifically, the alignment apparatus operates to position the strand guide 1 in a predetermined axial position which is indicated by the axis 17. In conjunction with the positioning of the strand guide 1 at the axis 17, the movable service unit is controlled to effect positioning of the insertion device 24 at the axis 17 for inserting the strand 33 in the strand guide 1 when the strand guide 1 is also aligned with the axis 17.

The alignment of the strand guide 1 at the axis 17 is accomplished through the transmission of a signal from the sensor 22 to the control unit 23 upon alignment of the sensor 22 with the control unit 23. As can be understood, the sensor 22 is axially positioned on the shaft 2 relative to the strand guide 1 such that the sensor 22 is aligned with the control unit 23 when the strand guide 1 is positioned at the axis 17. Moreover, the notch of the positioning notch member 9 is axially located with respect to the shaft 2 such that, when the arm 7 is received in the notch, the strand guide 1 is positioned at the axis 17. Upon receipt of the signal from the sensor 22, the control unit 23 operates the electromagnetic assembly to cause the counterweight 14 to drop. The downward movement of the counterweight 14 effects pivoting of the counterweight arms 10', 10'' about the cylindrical shaft 2. In turn, the pivoting of the counterweight arms 10', 10'' effects counterclockwise movement (as viewed in FIG. 3) of the cross shaft 11 about the cylindrical shaft 2. As the cross shaft 11 rotates counterclockwise, it moves the arm 7 from the solid line position shown in FIG. 3 to the broken line position shown in FIG. 3. In the broken line position shown in FIG. 3, the arm 7 is received in the positioning notch 9 and the force of gravity acting on the counterweight 14 serves to continually urge the arm 7 into the positioning notch 9.

Accordingly, the movement of the arm 7 from the position in which is it is received in the drive plate notch 4 to the position in which it is received in the positioning notch 9 simultaneously acts to uncouple the cylindrical shaft 2 from the reciprocating movement of the drive plate 3 and to fixedly secure the cylindrical shaft 2 at the axial position in which the strand guide 1 is aligned with the axis 17.

When the strand guide 1 is aligned with the axis 17, the insertion device 24 of the movable service unit is operated to effect insertion of the strand 33 into the strand guide 1. Since the strand guide 1 is always positioned at the axis 17 when a strand is to be inserted in the strand guide, the movable service unit can be programmed to repetitively position the strand 33 at a ready position adjacent the axis 17 for insertion of the strand into the strand guide 1, thereby resulting in an efficient strand inserting operation. Once the strand 33 is inserted into the strand guide 1, the end of the strand can be engaged in conventional manner by the first pair of rollers of the drafting device.

Once the insertion of the strand 33 has been accomplished, the control unit 23 operates the electromagnetic assembly to effect upward movement of the counterweight 14. The upward movement of the counterweight 14 effects movement of the cross shaft 11 in a clockwise direction (as viewed in FIG. 3) and the arm 7 falls under its own weight from the broken line position in which it is received in the positioning notch 9 to the solid line position in which it is received in the drive plate notch 4. If the drive plate notch 4 is not aligned with the arm 7, the arm 7 rests on the top of the driven plate 3 until the driven plate notch 4 again comes into alignment with the arm 7.

Figure 4:
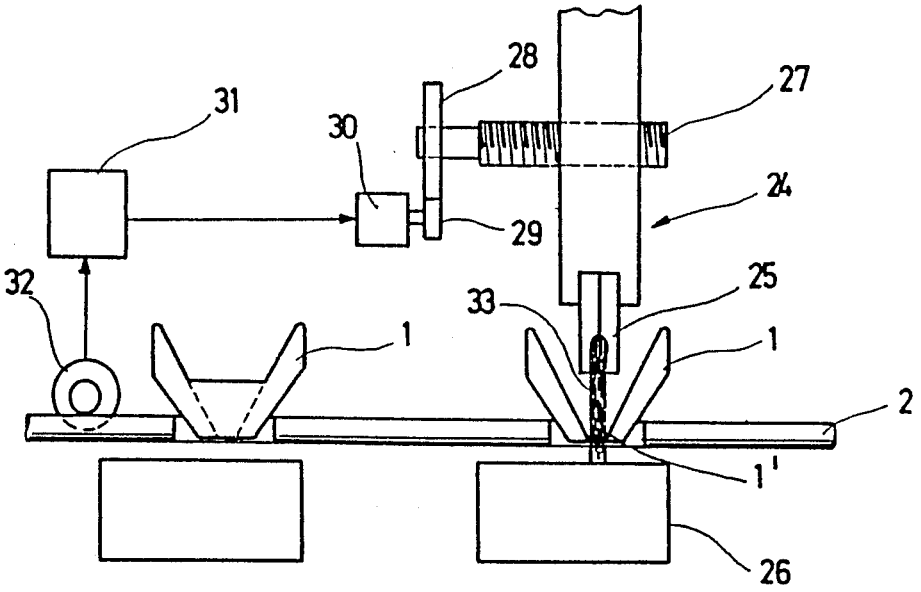
FIG. 4 is a front elevational view of another embodiment of the aligning apparatus of the present invention.

In FIG. 4, another embodiment of the alignment apparatus of the present invention is illustrated. A reciprocal member such as, for example, a shaft 2 is reciprocated in conventional manner by reciprocating means (not shown) to effect reciprocating movement of a strand guide 1 mounted on the shaft. The strand guide 1 guides the feed of a strand of textile material 33 from a supply of the strand material to the first pair of rollers 26 of a drafting device of a textile machine. A sensor 32 is fixedly secured to the shaft 2. The sensor 32 can be, for example, a tachoalternator or an incremental transmitter, and is operable to transmit a signal to a control unit 31. A conventional movable service unit (not shown) includes an initial strand inserting means 24 having a strand clamping device 25 for clamping the strand 33. The strand clamping device 25 includes a housing having an inner threaded bore. A threaded drive member 27 has a plurality of external threads configured to threadably engage the threaded inner bore of the strand clamping device 25. A gear 28 is mounted adjacent one end of the drive member 27. A drive motor 30, which can be, for example, a conventional electric motor, includes a drive shaft having a gear 29 fixedly mounted to the end thereof. The gears 28, 29 are meshingly engaged with one another for transmitting driving rotation therebetween. The drive motor 30 is operatively connected to the control unit 31. The strand guide 1 includes an opening 1′ defined between a pair of oppositely tapering arms.

In operation, the alignment apparatus illustrated in FIG. 4 is operable to insert the end of the strand 33 into the opening 1′ of the strand guide 1. The sensor 32 and the control unit 31 are configured such that the control unit 31 receives a signal from the sensor 32 when the strand guide 1 is positioned in a predetermined position. Upon receipt by the control unit 31 of the signal from the sensor 32, the reciprocal movement of the shaft 2 is ceased. The control unit 31 then controls the operation of the motor 1 to effect rotation of the gears 28, 29 and, thus, rotation of the drive member 27. The rotation of the external threads of the drive member 27 relative to the inner threaded bore of the strand clamping device 25 causes axial movement of the initial strand inserting means 24 relative to the strand guide 1. The control unit 31 controls the operation of the motor 30 to effect centering of the strand clamping device 25 with respect to the opening 1′ of the strand guide 1. Once the strand 33 is aligned with the opening 1′, the strand is fed through the opening 1 to the first pair of rollers 26 for feeding to the drafting device.

Figure 5:
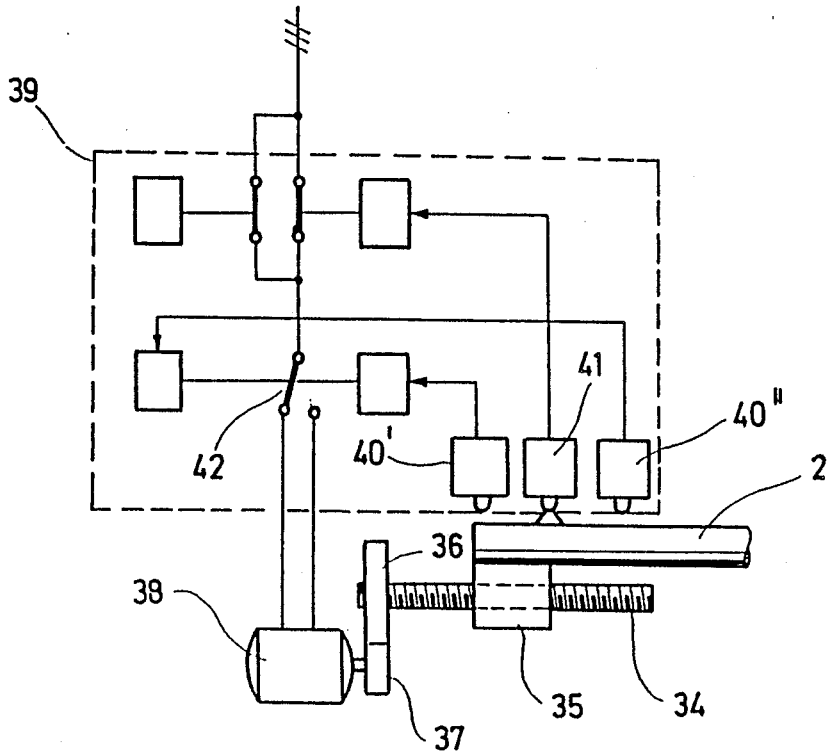
FIG. 5 is an elevational view of a portion of an alternative embodiment of the aligning apparatus of the present invention.

In FIG. 5, another embodiment of the alignment apparatus of the present invention is illustrated. A reciprocal member such as, for example, a shaft 2, is coupled to a means (not shown) for reciprocating the shaft 2 during operation of a drafting device to effect reciprocating movement of a strand guide (not shown) secured to the shaft 2. The shaft 2 includes a positioning projection extending laterally therefrom. A member 35 is fixedly secured to the shaft 2 and extends radially therefrom. The member 35 is provided with an inner threaded bore. A cylindrical drive member 34 has a plurality of external threads compatibly configured for threading engagement with the inner threaded bore of the member 35. A gear 36 is fixedly mounted to one end of the cylindrical drive member 34. A drive motor 38 which can be, for example, a conventional electric motor, includes a shaft having a gear 37 fixedly mounted at the end thereof. The gears 36, 37 are configured for meshing engagement with one another and the gear 37 is selectively movable by a conventional means (not shown) for movement of the gear into and out of meshing engagement with the gear 36.

A target sensor 41 is operatively connected to a control unit 39. A left-hand sensor 40′ and a right-hand sensor 40″ are operatively connected to the control unit 39. The target sensor 41, the left-hand sensor 40′, and the right-hand sensor 40″ are each configured to transmit a signal to the control unit 39 in response to the positioning of the positioning projection on the cylindrical shaft 2 in alignment with the respective sensor. The sensors are each positioned at a different axial position with respect to the shaft 2.

The control unit 39 includes a reversing switch 42 operatively connected to the left-hand sensor 40′ and the right-hand sensor 40″. The reversing switch 42 is operatively connected to the connector extending between the motor 38 and its power source and is operable to control rotation of the drive shaft of the motor 38 in opposite directions in response to signals received from the left-hand sensor 40′ and/or the right-hand sensor 40″.

In operation, the alignment apparatus illustrated in FIG. 5 is operable to align the strand guide on the shaft 2 in a predetermined position for insertion therein of a strand. To effect insertion of a strand into the strand guide, the shaft 2 is uncoupled from the reciprocal movement means. The gear 37 is moved into meshing engagement with the gear 36. The control unit 39 then controls the operation of the motor 38 in response to the position of the sensing projection on the shaft 2 as sensed by the left-hand sensor 40′, the target sensor 41 and/or the right-hand sensor 40″. Specifically, if the positioning projection of the shaft 2 is aligned with the left-hand sensor 40′, the left-hand sensor 40′ signals the control unit 39 to control the motor 38 to effect rotation of the gear 37 such that the shaft 2 is axially moved in the axial direction from the left-hand sensor 40′ to the target sensor 41. The rotation of the gear 37 effects rotation of the drive member 34 within the inner threaded bore of the member 35, thereby effecting movement of the member 35 relative to the drive member 34. Once the positioning projection on the shaft 2 is aligned with the target sensor 41, the target sensor 41 signals the control unit 39 to stop the operation of the motor 38 and the insertion of the strand into the strand guide by the initial strand inserting means is then performed.

Similarly, if the positioning projection of the shaft 2 is axially aligned with the right-hand sensor 40'' when the aligning operating begins, the right-hand sensor 40'' signals the control unit 39 to control the operation of the motor 38. The control unit 39 controls the reversing switch 42 to effect appropriate rotation of the drive shaft of the motor 38 such that the shaft 2 is moved in an axial direction from the right-hand sensor 40'' toward the target sensor 41. Once the positioning projection on the shaft 2 is aligned with the target sensor 41, the strand insertion operation is performed. Upon completion of the strand insertion operation, the shaft 2 is again coupled to the reciprocal driving means for normal operation.

Figure 6:
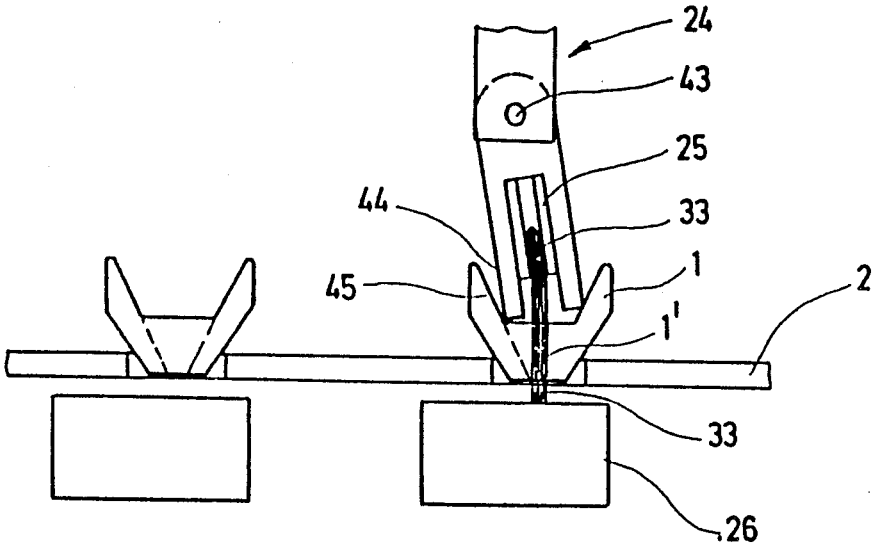
FIG. 6 is a front elevational view of a modification of the aligning apparatus of the present invention.

In FIG. 6, another embodiment of the alignment apparatus of the present invention is illustrated. A reciprocable member such as, for example, a shaft 2 is operatively coupled to a means (not shown) for reciprocating the shaft during operation of a drafting device to effect reciprocating movement of a strand guide 1 relative to the drafting device during the feed of a strand through the strand guide 1 to the drafting device. A means 24 for initially inserting the strand into the strand guide is operatively connected to a movable service unit (not shown) and is operable to insert a strand from a supply of a strand of textile material into the yarn guide 1. The initial strand inserting means 24 includes a main portion having a channel for the feed therethrough of the strand and a strand clamping device 25 pivotally mounted at a pivot 43 to the main portion. The strand clamping device 25 includes a coupling guide member 44 having a central channel for the passage of the strand 33 therethrough. The strand guide 1 includes a coupling receptacle 45 defined by a pair of arms projecting radially in the same direction from the shaft 2. The arms of the strand guide 1 define an opening 1' therebetween and the axial spacing between the free ends of the arms is greater than the side to side extent of the coupling guide member 44 of the strand clamping device 25.

In operation, the initial strand inserting means 24 and the strand guide 1 cooperate with one another to effect insertion of the strand 23 into the strand guide 1 during movement of the shaft 2 in its normal reciprocating operation or when the shaft 2 is stationary. To insert a strand, the initial strand inserting means 24 is moved in a radial direction with respect to the shaft 2 toward the shaft 2 while the initial strand inserting means 24 is axially aligned with the strand guide 1. The coupling guide member 44 of the strand clamping device 25 is eventually received between the free ends of the arms of the strand guide 1 as the inserting means 24 approaches the shaft 2. Once the coupling guide member 44 is inserted into the coupling receptacle 45 of the strand guide 1, the strand 33 is fed through the channel of the coupling guide member 44 and through the opening 1' of the strand guide 1 to the first pair of rollers 26 of the drafting device. As can be understood, the strand clamping device 25 pivots about the pivot 43 to accommodate relatively limited axial misalignment between the housing of the initial strand inserting means 24 and the strand guide 1.

Figure 7:
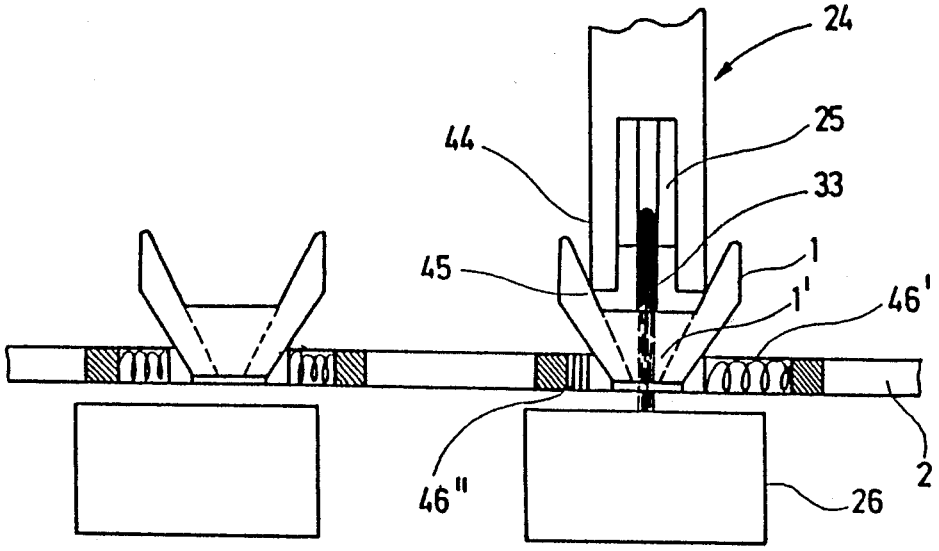
FIG. 7 is a front elevational view of a further modification of the aligning apparatus of the present invention.

In FIG. 7, a further embodiment of the alignment apparatus of the present invention is illustrated. A reciprocable member such as, for example, a shaft 2 has a plurality of strand guides 1 for guiding strands to a drafting device. A means (not shown) is provided for reciprocating the shaft 2 during operation of the drafting device to effect reciprocating movement of the strand guides 1 relative to the drafting device. Each strand guide 1 includes a pair of arms projecting radially in the same direction from the shaft 2, each pair of arms defining therebetween a coupling receptacle 45. Additionally, each strand guide 1 includes an opening 1' opening centrally into the coupling receptacle 45 of the strand guide. Each strand guide 1 is movably mounted to the shaft 2 for relative axial movement therewith. A spring 46' extends between the shaft 2 and one side of the strand guide 1. A spring 46'' extends between the shaft 2 and a side of the strand guide 1 generally axially opposite to the side against which the spring 46' contacts. Accordingly, each stand guide 1 is maintained in an axial equilibrium position with respect to the shaft 2 due to the oppositely directed urgings of the springs 46', 46''.

An initial strand inserting means 24 for initially feeding a strand 33 into the strand guides 1 includes a strand clamping device 25 having a central channel for clamping the strand 33. The strand clamping device 25 is centrally mounted in a coupling end portion 44 of the housing of the initial strand inserting means 24. The side to side extent of the coupling end portion 44 is less than the axial spacing between the free ends of the arms of the strand guide 1.

In operation, the initial strand inserting means 24 is moved in a radial direction with respect to the shaft 2 toward one of the strand guides 1 while the initial strand inserting means 24 is generally axially aligned with the strand guide 1. The coupling end portion 44 is eventually received between the arms of the strand guide in the coupling receptacle 45 as the inserting means 24 approaches the shaft 2. Once the coupling end portion 44 is received in the coupling receptacle 45, the strand 33 is fed through the strand clamping device 25 into the opening 1' of the strand guide 1 to the first pair of rollers 26 of the drafting device. If the central channel of the strand clamping device 25 is not axially aligned with the opening 1' of the strand guide 1 when the coupling end portion 44 is initially received in the coupling receptacle 45, the strand guide 1 moves axially relative to the shaft 2 to effect alignment of the opening 1' with the strand clamping device 25. During this relative axial movement of the strand guide 1, one of the springs 46', 46'' contracts while the other of the springs expands to accommodate the axial movement of the strand guide 1. Once the initial strand inserting means 24 has been withdrawn from engagement with the strand guide 1, the springs 46', 46'' return the strand guide 1 to its axial equilibrium position relative to the shaft 2.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. In a textile machine of the type having a supply of a strand of textile material and a device for drafting the strand of textile material, a reciprocable member, a strand guide mounted on the reciprocable member for guiding the strand from the strand supply to the drafting device, means for reciprocating the reciprocable member transversely with respect to the strand during operation of the drafting device to effect reciprocating movement of the strand guide relative to the drafting device during the feed of the strand through the strand guide to the drafting device, and means for initially inserting the strand into the strand guide, an apparatus comprising:

means for aligning the intial strand inserting means and the strand guide with respect to one another in an alignment position at which the strand is initially inserted into the strand guide.

2. In a textile machine, an apparatus according to claim 1 and characterized further in that said aligning means includes means for uncoupling the reciprocable member from the means for reciprocating the reciprocable member.

3. In a textile machine, an apparatus according to claim 2 and characterized further in that said aligning means includes a device for selectively securing the reciprocable member at a predetermined position, in alignment for initial insertion of a strand in the strand guide by the initial strand inserting means.

4. In a textile machine, an apparatus according to claim 3 and characterized further in that said aligning means includes a laterally projecting member mounted to the reciprocable member for movement therewith during the reciprocating movement, said laterally projecting member being movable about the axis of reciprocation of the reciprocable member and said means for selectively securing the reciprocable member at a predetermined position includes a projection receiving member for receiving said laterally projecting member therein when the reciprocable member is uncoupled from the means for reciprocating the reciprocable member and a device for selectively moving said laterally projecting member into and out of engagement with said projection receiving means.

5. In a textile machine, an apparatus according to claim 4 and characterized further in that said uncoupling means includes a receiving component formed in the means for reciprocating the reciprocable member for receiving said laterally projecting member therein to effect coupling of the means for reciprocating the reciprocable member and the reciprocable member and said means for selectively moving said laterally projecting member moves said laterally projecting member alternately into engagement with one of said projection receiving members of the means for reciprocating the reciprocable member and the means for selectively securing the reciprocable member, and out of engagement with the other of the means for reciprocating the reciprocable member and the means for selectively securing the reciprocable member.

6. In a textile machine, an apparatus according to claim 5 and characterized further in that said aligning means includes means for sensing the positioning of the strand guide at said alignment location, said means for selectively moving said laterally projecting member acting to move said laterally projecting member in response to the sensing of the strand guide at said alignment location to uncouple the reciprocable member from the means for reciprocating the reciprocable member.

7. In a textile machine, an apparatus according to claim 2 and characterized further in that said aligning means includes means for sensing the position of the strand guide and means, operatively connected to said sensing means, for moving the reciprocable member in response to the sensed position of the strand guide to position the strand guide at said alignment position.

8. In a textile machine, an apparatus according to claim 2 and characterized further in that said aligning means includes a first component disposed on the initial strand inserting means and a second component disposed on the reciprocable member adjacent the strand guide, said first and second components cooperating together to form a passage for travel of the strand therethrough from the initial strand inserting means to the strand guide at said alignment position.

9. In a textile machine, an apparatus according to claim 2 and characterized further in that said aligning means includes a laterally projecting member mounted to the reciprocable member for movement therewith during the reciprocating movement, said laterally projecting member being movable about the axis of reciprocation of the reciprocable member and said uncoupling means includes a member formed in the means for reciprocating the reciprocable member for receiving said laterally projecting member therein and a device for selectively moving said laterally projecting member into and out of engagement with said receiving member.

10. In a textile machine, an apparatus according to claim 1 and characterized further in that said aligning means includes means for sensing the position of the strand guide and means, operatively connected to said sensing means, for moving the initial strand inserting means relative to the strand guide to align the initial strand inserting means and the strand guide with one another at said alignment position.

11. In a textile machine, an apparatus according to claim 10 and characterized further in that said sensing means is a tacho-alternator.

12. In a textile machine, an apparatus according to claim 1 and characterized further in that said aligning means includes a first component disposed on the intial strand inserting means and a second component disposed on the reciprocable member adjacent the strand guide, said first and second components cooperating together to form a passage for travel of the strand therethrough from the initial strand inserting means to the strand guide at said alignment position.

13. In a textile machine, an apparatus according to claim 12 and characterized further in that said second component disposed on the reciprocable member includes a pair of laterally projecting, axially spaced arms, each of said arms being axially displaced from the strand guide in a respective axial direction with respect to the reciprocable member, the initial strand inserting means includes a portion having a channel for feed of the strand therethrough and said first component of the initial strand inserting means is movable with respect to said channel portion and compatibly configured for receipt between said arms of said second component.

14. In a textile machine, an apparatus according to claim 12 and characterized further in that said second component disposed on the reciprocable member includes a pair of laterally projecting, axially spaced arms, each of said arms being axially displaced from the strand guide in a respective axial direction with respect to the reciprocable member, said second component being axially movable with respect to the reciprocable means during receipt of said end portion in said arms and the initial strand inserting means includes an end portion for feed therethrough of the strand, said end portion being receivable between said arms.

* * * * *